US008470053B2

(12) United States Patent
Dawudian

(10) Patent No.: US 8,470,053 B2
(45) Date of Patent: Jun. 25, 2013

(54) COMPOSITIONS FOR LAUNDERING AND SUBSEQUENTLY DRYING DELICATE GARMENTS WITHOUT INCURRING ANY DAMAGE AND METHODS TO USE THEM

(75) Inventor: Fariborz Dawudian, Paris (FR)

(73) Assignee: Fariborz Dawudian, Paris (FR)

( * ) Notice: Subject to any disclaimer, the term of this patent is extended or adjusted under 35 U.S.C. 154(b) by 1 day.

(21) Appl. No.: 12/439,327

(22) PCT Filed: Feb. 2, 2009

(86) PCT No.: PCT/FR2009/000200

§ 371 (c)(1),
(2), (4) Date: Sep. 15, 2011

(65) Prior Publication Data

US 2012/0017378 A1 Jan. 26, 2012

(51) Int. Cl.

| | |
|---|---|
| ***B08B 3/04*** | (2006.01) |
| ***C11D 1/00*** | (2006.01) |
| ***C11D 3/2003*** | (2006.01) |
| ***C11D 3/30*** | (2006.01) |
| ***C11D 3/36*** | (2006.01) |
| ***C11D 3/37*** | (2006.01) |
| ***C11D 7/08*** | (2006.01) |

(52) U.S. Cl.

USPC ..... 8/137; 8/142; 510/276; 510/288; 510/289; 510/290; 510/291; 510/322; 510/340; 510/342; 510/347; 510/351; 510/360; 510/421; 510/426; 510/467; 510/492; 510/505

(58) Field of Classification Search

CPC . B08B 3/04; C11D 1/00; C11D 3/2003; C11D 3/30; C11D 3/36; C11D 3/37; C11D 7/08

USPC ..... 510/276, 288, 289, 290, 291, 322, 510/340, 342, 347, 351, 360, 421, 426, 467, 510/492, 505; 8/137, 142

See application file for complete search history.

(56) References Cited

U.S. PATENT DOCUMENTS

| | | | |
|---|---|---|---|
| 3,954,647 | A | 5/1976 | Neros et al. |
| 4,115,061 | A | 9/1978 | Grunewalder |
| 4,118,344 | A | 10/1978 | DeShon |
| 4,135,879 | A | 1/1979 | Hasenclever |
| 4,405,511 | A | 9/1983 | Hasenclever |
| 4,406,809 | A | 9/1983 | Hasenclever |
| 5,002,684 | A | 3/1991 | Beck et al. |
| 5,634,947 | A | 6/1997 | Kazama |
| 5,888,250 | A | 3/1999 | Hayday et al. |
| 6,036,727 | A | 3/2000 | Smith |
| 6,042,617 | A | 3/2000 | Berndt |
| 6,063,135 | A | 5/2000 | Berndt et al. |
| 6,086,634 | A | 7/2000 | Smith |
| 6,139,587 | A | 10/2000 | Nair et al. |
| 6,156,074 | A | 12/2000 | Hayday et al. |
| 6,273,919 | B1 | 8/2001 | Hayday |
| 6,350,287 | B1 | 2/2002 | Hayday |
| 6,407,053 | B1 | 6/2002 | Randall et al. |
| 2006/0018567 | A1 | 1/2006 | Curry et al. |
| 2006/0110997 | A1 * | 5/2006 | Snowden ..... 442/79 |

FOREIGN PATENT DOCUMENTS

| | | |
|---|---|---|
| CA | 2531234 | 5/2000 |
| EP | 1123377 | 3/2004 |
| EP | 1123432 | 3/2005 |
| WO | 95004128 | 2/1995 |
| WO | 98053131 | 11/1998 |
| WO | 98056975 | 12/1998 |

* cited by examiner

*Primary Examiner* — Brian P Mruk

(74) *Attorney, Agent, or Firm* — Trego, Hines & Ladenheim, PLLC

(57) ABSTRACT

The present invention relates to compositions and methods for wet-cleaning, in professional or household washing machine equipment, and subsequent drying in a tumbler dryer, of garments made of protein-fibers (animal based fibers) such as wool, cashmere, silk and other sensitive fibers. Using water and certain additives instead of organic solvents, these compositions enable the cleaning, including oil stains removal, and subsequent drying without incurring dimensional changes, shrinkage, surface damages, dye or color loss of dry clean only labeled garments or other delicate garments labeled for special care.

20 Claims, No Drawings

COMPOSITIONS FOR LAUNDERING AND SUBSEQUENTLY DRYING DELICATE GARMENTS WITHOUT INCURRING ANY DAMAGE AND METHODS TO USE THEM

BACKGROUND OF THE INVENTION

The present invention relates to compositions and methods to allow wet-cleaning, including oil stain removal, and subsequently drying in a tumbler dryer, of sensitive garments and other fabrics made of water-sensitive protein fibers such as wool, cashmere or silk without any dimensional changes, surface damages and dye or color loss. These compositions and methods can be applied in a professional or household cleaning process.

Sensitive garments and other fabrics may be cleaned and dried in a variety of manners using professional wet or dry cleaning processes or modern household laundry equipment. Sensitive items including garments and fabrics made of hair, silk, rayon, animal hair, animal skin and mixed spun materials, have a tendency to shrink when they are washed in water. In order to avoid shrinkage caused by washing in water, many of these sensitive garments and fabrics are conventionally dry cleaned.

Dry Cleaning

By definition, the term "dry cleaning" has been used to describe processes for cleaning textiles using non-aqueous solvents. Dry cleaning is an old art first discovered in the mid-19$^{th}$ century when potential to use petroleum-based solvents to remove grease, wax and oil-based stains from textiles was discovered. Solvent cleaning was first recorded in the United Kingdom in the 1860s with gasoline and kerosene as first solvents used.

Chlorinated solvents were introduced after World War I; since the mid-1930s the most commonly used solvent has been tetrachloroethylene, also called perchloroethylene which has the advantage of being stable, non flammable, and having better cleaning capabilities than aqueous solvents for removal of oil-based stains. Since that time most fabrics having a tendency to shrink by contact of water, or which are judged to be too valuable or delicate to be subjected to aqueous laundering processes, are dry cleaned.

While perchloroethylene is superior to the non-aqueous solvents that it replaced, it has several disadvantages. Particularly, perchloroethylene has been identified as a hazardous air and ground water pollutant (listed as such under the Clean Air Act by the U.S. Environmental Protection Agency and declared as a toxic chemical by California in 1991); it has been also long associated with nervous-system, severe skin irritation, liver and kidney disorders amongst industrial workers and listed as probable carcinogen by the International Agency for Research on Cancer (IARC) in 1995. Recent studies revealed that perchloroethylene's potential carcinogenic effects are not limited solely to industrial workers or those who operate dry clean processes; some commercial dry cleaners used such high amounts of perchloroethylene to clean garments, that customers who wore freshly dry-cleaned garments could inhale enough perchloroethylene to incur a slightly increased risk of cancer. Perchloroethylene will become illegal in California in 2023.

As a consequence of this hazardous nature of perchloroethylene, processes utilizing it must be done at commercial establishments. Traditional dry cleaning involves solvent-using wash cycle and several filtration steps to recover some of the solvent through filtration units comprising a distillation boiler and condenser. Distilled solvent is recovered during extraction and drying cycles. Dry cleaning produces toxic waste residues that have to be regularly removed by the operator such as solid waste sludge, lint and cartridge filters still containing traces of solvent. Leakage of solvents and leakage of ozone-damaging refrigeration gases are further risks specific to dry cleaning.

In recent years, the industry has responded with less-toxic alternatives to perchloroethylene, including hydrocarbons (EcoSolv™ drycleaning fluid from CPChem) and glycol ethers. One glycol ether, dipropylene glycol n-propyl ether (DPnP), has been used in combination with other components like polysulfonic acid (U.S. Pat. Nos. 6,086,634; and 6,036,727). Another allegedly environmentally friendly alternative to perchloroethylene is available from GreenEarth. Cleaning, using a cyclic siloxane optionally in combination with a glycol ether (U.S. Pat. Nos. 6,042,617 and 6,063,135). While they do have lower toxicity, siloxanes have relatively low cleaning power and are preferably avoided. Other glycol ethers have been recommended for use in dry cleaning, more particularly propylene glycol tert-butyl ether (PTB), propylene glycol n-butyl ether (PNB), dipropylene glycol tert-butyl ether (DPTB) and dipropylene glycol n-butyl ether (DPNB) (U.S. Pat. Nos. 5,888,250; 6,156,074; 6,273,919 and 6,350,287 from Rynex Holdings Ltd.). Use of glycol ethers represents a significant step toward replacing perchloroethylene in dry cleaning, but the industry continues to need a better replacement for it.

Solvent-based dry cleaning processes present several limits and/or disadvantages compared to wet cleaning:

While solvent-based dry cleaning processes are quite effective for removing oily soils and stains, they are not optimal for removing particulates such as clay soils or the water-soluble stains such as the sugars, commonly found in many fruit drinks and carbonated beverages; it may also require special treatment conditions to remove proteinaceous stains.

Traditional dry cleaning involves energy intensive processes consuming approximately 40%. more energy than traditional wet cleaning and consuming more water in the dry cleaning process for an equal poundage of garments cleaned.

Moreover, dry cleaning equipments are substantially more capital intensive compared to wet cleaning equipments. It also compares unfavourably as to the operating costs, and specifically with regard to solvent sludge and filter removal requirement, higher repair and maintenance costs due to higher technical complexity and higher consumption of energy and water.

Wet Cleaning

Wet cleaning is a non-toxic, environmentally safe alternative to dry cleaning, utilizing computer-controlled washing machines, biodegradable soaps and conditioners, and various types of pressing equipment that may be specialized for many different fabric and fiber types. Modern wet-cleaning technology was developed by Miele in early 1990s and involves the use of water as solvent instead of organic solvents. Water usage as a solvent offers several advantages:

- Approximatively 98%. of all stains are water-soluble or can be carried away by water.
- Water is able to clean almost all textiles and leathers except certain textiles with water-soluble coatings.
- Cleaning quality of water is superior to any traditional solvent, by removing stains rather than spreading.

The wet cleaning process in a professional wet cleaning operation is similar to washing garments in a modern household washing machine, albeit in a controlled environment regarding to speed, temperature and water volumes. Professional wet cleaning operations require specially designed equipment such as wet cleaning machines and dryers.

Compared to dry cleaning, professional wet cleaning equipment is easier to operate and maintain because of lower technical complexity; it also requires considerably less pre-spotting because most stains are water-soluble. Nevertheless, wet cleaning process require moderately more sorting prior to cleaning because of more delicate cleaning and also moderately more finishing time.

Even if the quality of wet cleaning has improved since the early 1990s, modern wet cleaning compositions and methods still provoke damage to garments in form of color loss and dimensional changes like shrinkages.

In the traditional water-based washing process, dimensional changes and color loss are the results of water penetrating into the cavities of the fibers and during the drying process in a tumbler evaporation of water, of water creating access of pressure resulting in damage to the protein fibers.

Then, to avoid or reduce a potential shrinkage effect, cleaning is conducted in low water temperature with poor cleaning results particularly regarding oil and oil-soluble stains that, consequently, can not be removed.

Several prior art systems have been proposed for wet cleaning of clothing that is conventionally dry cleaned:

U.S. Pat. No. 5,634,947 discloses a wet cleaning system that uses a solvent of propylene glycol monomethyl ether containing 4% to 50% by volume of water.

WO 98/56975 teaches a shrinkage prevention agent that contains at least one organic acid, with terpene and phenol of plant origin as its effective components. Amongst organic acids acetic acid is listed with cyclotene, 2-cyclopentenone, para-cresol, meta-cresol, orthocresol, furfural alcohol and guaiacol, in addition to other components in trace amounts. The anti-shrinkage agent is used as 0.01-0.05 parts by volume per 100 parts of regular water.

Process and compositions for wet cleaning of delicate garments with minimal wrinkling, shrinkage and color damage have been proposed in U.S. Pat. No. 6,139,587 using a method involving soaking of the garments in a certain type of surfactant-containing aqueous solution under specific conditions requiring five different steps.

However, after this wet-cleaning process, the garments are typically hanged to dry in the open air overnight. Then, to soften the fibers which generally stick together and create a "rough" surface, garments are subsequently tumbled cold. To avoid this roughness, wet cleaners typically either add cationic surfactants (softeners) during the last rinse of the washing cycle, thereby coating the garments against sticking, or put the dry garments into the garments dryer to soften them mechanically.

Household

CA 2,531,324 addresses the question of laundering processes of sensitive garments in a conventional home washing machine. The use of aqueous laundering process in a conventional washing machine is considerably more convenient and inexpensive than virtually any other laundering method, but can produce inacceptable results when applied to a broad range of delicate or dry-clean only garments. The system in CA 2,531,324 uses a flexible polymer wrap container to avoid abrasion and stress that severely damage the garments.

Specially formulated household washing products may be purchased for the washing of sensitive garments. However, similar to modern wet cleaning, this still requires the garments to be hanged to dry which typically still provokes stickiness of the fibers, creating a rough garment surface. The use of softeners results in residues and leaves a "greasy" texture.

Traditionally, wet cleaning operations could not compete with dry cleaning due to the lack of process and technology not allowing all garments to be cleaned in water and finished in a similar time frame.

Given the foregoing, there is clearly a continuing and ongoing need to develop simple, aqueous laundering compositions and procedures to clean delicate garments and strike an appropriate balance between effective stain and soil removal, and avoided fabric damages, dimensional changes and color loss.

This is an object of the present invention to avoid well-known drawbacks associated to classical dry cleaning and wet cleaning alternatives of sensitive garments and to propose efficient and simple solutions for their wet cleaning and drying in professional or household equipment without any dimensional changes, shrinkage, surface damages, dye or color loss.

SUMMARY OF THE INVENTION

The object of the present invention is to propose methods and associated compositions for wet cleaning and drying of all-types of delicate garments allowing efficient stain removal, including oil stains removal, on sensitive garments generally unsuitable for water washing, without incurring dimensional changes, shrinkage, surface damages, dye or color loss. Compositions and methods of the present invention are usable in a professional or household washing and tumbler drying equipment.

By temporary applying a protecting coating, relaxing and softening the protein fibers, the garments of all kinds of fibers can be washed and dried with an aqueous solution without damage to the fibers in a similar way as in the dry cleaning process based on non-polar organic solvents.

The present invention proposes to solve sensitive garments cleaning and drying without damaging them by a method using at least one main washing step involving a washing composition, described in the present invention and optionally two rinsing steps involving one preconditioning and/or one conditioning compositions, respectively described in the present invention.

Compositions allowing to carry out the method of the present invention are detailed as follow:

The washing composition contains water, an alcohol present at a volume ranging from 5% to 40% of the total volume of the composition, a mixture of anionic surface active components present at a volume ranging from 4% to 60% of the total volume of the composition, a mixture of non anionic surface active components present at a volume ranging from 4% to 40% of the total volume of the composition, a phosphate ester present at a volume ranging from 4% to 30% of the total volume of the composition, citric acid and soluble salts thereof present at a volume ranging from 0.1 to 4%, phosphoric acid and soluble salts thereof present at a volume ranging from 0.1% to 5% of the total volume of the composition, acetic acid and soluble salts thereof present at a volume ranging from 0.1 to 4% and an organic amine present at a volume ranging from 0.1% to 4% of the total volume of the composition.

The preconditioning composition which pH value is adjusted in the range of 4 to 6, contains water, an alcohol present at a volume ranging from 5% to 40% of the total volume of the composition, a phosphate ester present at a volume ranging from 4% to 30% of the total volume of the composition, citric acid and soluble salts thereof, present at a volume ranging from 0.01% to 5% of the total volume of the composition, phosphoric acid and soluble salts thereof present at a volume ranging from 1% to 20% of the total volume of the composition and acetic acid and soluble salts thereof present at a volume ranging from 0.01% to 5% of the total volume of the composition.

The conditioning composition contains water, tripropylene Glycol present at a volume ranging from 0.1% to 4% of the total volume of the composition and a fluoroalkyl acrylate copolymer present at a volume ranging from 2% to 15% of the total volume of the composition.

Regarding Washing and Preconditioning Compositions:

alcohols entering in the compositions are selected amongst the alcohols of the formula Cn H2n+1 OH where n is 1, 2, 3 or 4.

phosphate ester is selected from a group comprising complex mono- or diester with an alkyl ether carbon chain C12-C15 and EO-2-10.

citric acid salts are sodium, potassium, or ammonium salts of citrate acid or a mixture thereof phosphoric acid salts are sodium, potassium or ammonium salts of phosphoric acid or a mixture thereof acetic acid salts are sodium, potassium or ammonium salts of acetate acid or a mixture thereof.

Regarding Washing Compositions:

the mixture of anionic surface active components is composed of isopropylamine salts of a mixture of linear alkylbenzene sulfonic acids wherein the alkyl groups contain from 7 to 14 carbon atoms. About 19 to 25%. of the linear alkylbenzene sulfonic acid salt have the benzene sulfonic acid in position 2 of the alkyl group.

the mixture of non anionic surface active components is composed of a group consisting of non-ionic primary alcohol alkoxylate wherein high linear primary alcohol represents 75-85%. and contain even and odd numbered carbon chain in sub 20. Non ionic primary alcohol alkoxylate is preferably an ethoxylate alcohol with carbon atoms chain between 8 to 18 carbon atoms.

organic amine is selected from a group consisting of dietholamine, trietholamine or a mixture thereof.

Regarding the Conditioning Composition:

the fluororoalkyl acrylate copolymer is composed of a fluorinated monomer, acrylic acid containing monomer and a calcium-, magnesium-, aluminium-acrylate or styrene sulfonate.

As mentioned, the invention relates to a method for cleaning and drying garments made of fabrics which can be damaged via conventional cleaning/drying operations. Such a method involves at least a step of washing of the garments in a certain type of additive-containing aqueous washing composition, under specific conditions, and optionally two steps of rinsing of the garments in one aqueous preconditioning composition and/or one aqueous conditioning composition, respectively containing specific additives, to be used under specific conditions. Depending on the need to use these different aqueous compositions, these are followed by specific draining, extracting and drying steps that are detailed hereafter. The method of the present invention is designed to be used in household type or professional type washer and dryer or washer/dryer.

In a first aspect, the method of the present invention is appropriate for cleaning and drying in a tumbler dryer sensitive, garments without damage, in a household type washer and dryer or washer/dryer with a woolen cycle. In this first aspect, the method of the present invention is characterized by successively washing the garments in the washing composition of the present invention, tumbling them dry to a moisture level in the range of 10% to 15%. Ironing or static drying removes all remaining moisture in the garments.

In a second aspect, the method of the present invention is appropriate for cleaning and drying in a tumbler dryer sensitive garments without damage, in a commercial wet-cleaning washer and dryer or washer/dryer. In this second aspect, the method is characterized by successively washing the garments in the washing composition of the present invention, rinsing them in the conditioning composition of the present invention, tumbling them dry to a moisture level in the range of 8% to 10%. Ironing or static drying removes all remaining moisture in the garments.

In a third aspect, the method of the present invention is appropriate for cleaning and drying in a tumbler dryer all kinds of sensitive garments without damage, in a commercial wet-cleaning washer and dryer or washer/dryer with a water circulation capability. In this third aspect, the method is characterized by successively washing the garments in the washing composition of the present invention, rinsing with the preconditioning composition of the present invention and in the final step rinsing with conditioning composition of the present invention, tumbling them dry completely or to a desired moisture level.

DETAILED DESCRIPTION OF THE INVENTION

In a traditional water-based washing process, dimensional changes and colour loss are the result of water penetrating into the cavities of the fibers and during the drying process in a tumbler evaporation of water creating access of pressure resulting in damages to the protein fibers. By temporary applying a protecting coating, relaxing and softening the protein fibers, the garments of all kinds of fibers can be washed and dried with an aqueous solution without damages to the fibers in a similar way as in the dry cleaning process based on non-polar organic solvents added to the efficiency of a wet cleaning process.

The object of the present invention is to propose methods and associated compositions for wet cleaning and drying of all-types of delicate garments allowing efficient stain removal, including oil stains removal, on sensitive garments generally unsuitable for water washing, without incurring dimensional changes, shrinkage, surface damages, dye or color loss.

By delicate or sensitive garments is meant especially sensitive protein-fibers such as wool, cashmere and silk, but also fabrics made of hair, silk, rayon, animal hair, animal skin and mixed spun materials and other delicate garments labeled for special care.

By cleaning or washing herein is meant removal of soils and stains from fabrics. The kinds of dirt occurring in textile can be subdivided into water-soluble dirt and water insoluble dirt that partly consists of suspendable or emulsifiable dirt. Water-soluble dirt comprises for example sugars, acids, salts and urea; water-insoluble dirt comprises for example sand, clay, proteins, fats, oils, soot, dyes and microorganisms. Suspendable and emulsifiable dirt comprises, inter alia, proteins, starch, foods, fats, oils, and blood constituents. By cleaning or washing herein is also meant removing of odors and smoke but also fire restoration.

By shrinkage herein is meant the reduction in one or two different measurements on a test garment. Specifically, wool trousers and wool sweaters were selected as test garments to determine the shrinkage resulting from various cleaning processes using various cleaning compositions compared to methods and compositions of the present invention. The two different measurements are taken before and after each treatment cycle after it has been placed on a hard, flat surface and smoothed by hand. When trousers are taken as test garments, the reference measurement is the distance from the bottom hem of the leg sleeve to the hem of the hip. When sweaters are taken as test garments, the reference measurement is the distance from the bottom hem of one sleeve to the approximate mid-point of the hem joining the sleeve to the sweater's body.

By surface damages and dye/color loss is meant deterioration of fabrics integrity and appearance that can manifest itself in several ways. Short fibers are dislodged form woven and knit fabric/textile structures by the mechanical action of laundering. These dislodged fibers may form lint, fuzz or pills which are visible on the surface of fabrics and may diminish the appearance of newness of the fabric. Further repeated laundering of fabrics can remove dye from them and impart a faded appearance, as a result of diminished color intensity and in many cases, as a result of changes in hues or shades of color.

Compositions and methods of the present invention are usable in a professional or household washing and tumbler drying equipment.

The present invention proposes to solve sensitive garments cleaning and drying without damaging them by a method using at least one main washing step involving a said washing composition, described in the present invention and optionally two rinsing steps involving one said preconditioning and/or one conditioning compositions, respectively described in the present invention.

Compositions allowing to carry out the method of the present invention are detailed as follow:

Said washing composition of the present invention contains water, an alcohol present at a volume ranging from 5% to 40% of the total volume of the composition. Alcohols entering in the composition are selected amongst the alcohols of the formula Cn H2n+1 OH where n is 1, 2, 3 or 4, i.e methanol, ethanol, propanol, isopropanol and butanol. Said washing composition also contains a mixture of anionic surface active components present at a volume ranging from 4% to 60% of the total volume of the composition. The mixture of anionic surface active components is composed of isopropylamine salts of a mixture of linear alkylbenzene sulfonic acids wherein the alkyl groups contain from 7 to 14 carbon atoms. Alkylbenzene sulfonic acids are components in which the alkyl group contains from 7 to 14 carbon atoms, is in straight or branched chain configuration. About 19 to 25%. of the linear alkylbenzene sulfonic acid salt have the benzene sulfonic acid in position 2 of the alkyl group. Said washing composition also contains a mixture of non anionic surface active components present at a volume ranging from 4% to 40% of the total volume of the composition. The mixture of non anionic surface active components is composed of a group consisting of non-ionic primary alcohol alkoxylate wherein high linear primary alcohol represents 75-85%. and contain even and odd numbered carbon chain in sub 20. Non ionic primary alcohol alkoxylate is preferably an ethoxylate alcohol with carbon atoms chain between 8 to 18 carbon atoms. Said washing composition contains also a phosphate ester present at a volume ranging from 4% to 30% of the total volume of the composition. Phosphate ester present in the said washing composition is selected from a group comprising complex mono- or diester with an alkyl ether carbon chain C12-C15 and EO-2-10. Said washing compositions contain also citric acid and soluble salts thereof present at a volume ranging from 0.1 to 4%, phosphoric acid and soluble salts thereof present at a volume ranging from 0.1% to 5% of the total volume of the composition, acetic acid and soluble salts thereof present at a volume ranging from 0.1 to 4%. Citric acid salts, phosphoric acid salts and acetic acid salts are sodium, potassium, or ammonium salts or a mixture thereof. Said washing composition contains also an organic amine present at a volume ranging from 0.1% to 4% of the total volume of the composition. Said organic amine is selected from a group consisting of dietholamine, trietholamine or a mixture thereof.

Said preconditioning composition of the present invention contains water, an alcohol present at a volume ranging from 5% to 40% of the total volume of the composition. Alcohols entering in the composition are selected amongst the alcohols of the formula Cn H2n+1 OH where n is 1, 2, 3 or 4, i.e methanol, ethanol, propanol, isopropanol and butanol. Said preconditioning composition contains also a phosphate ester present at a volume ranging from 4% to 30% of the total volume of the composition. Phosphate ester present in the said preconditioning composition is selected from a group comprising complex mono- or diester with an alkyl ether carbon chain C12-C15 and EO-2-10. Said preconditioning composition contain also citric acid and soluble salts thereof present at a volume ranging from 0.1 to 4%, phosphoric acid and soluble salts thereof present at a volume ranging from 0.1% to 5% of the total volume of the composition, acetic acid and soluble salts thereof present at a volume ranging from 0.1 to 4%. Citric acid salts, phosphoric acid salts and acetic acid salts are sodium, potassium, or ammonium salts or a mixture thereof PH value of the said preconditioning composition is adjusted in a range of 4 to 6, preferably 5.

Said conditioning composition of the present invention contains water, tripropylene glycol present at a volume ranging from 0.1% to 4% of the total volume of the composition and a fluoroalkyl acrylate copolymer present at a volume ranging from 2% to 15% of the total volume of the composition. Fluoroalkyl acrylate copolymer is composed of a fluorinated monomer, acrylic acid containing monomer and a calcium-, magnesium-, aluminium-acrylate or styrene sulfonate.

As mentioned, the invention relates to a method for cleaning and drying garments made of fabrics which can be damaged via conventional cleaning/drying operations. Such a method involves at least a step of washing of the garments in a certain type of additive-containing aqueous washing composition, under specific conditions, and optionally two steps of rinsing of the garments in one aqueous preconditioning composition and/or one aqueous conditioning composition, respectively containing specific additives, to be used under specific conditions. Depending on the need to use these different aqueous compositions, these are followed by specific draining, extracting and drying steps that are detailed hereafter. The method of the present invention is designed to be used in household type or professional type washer and dryer or washer/dryer.

In a first aspect, the method of the present invention is appropriate for cleaning and drying in a tumbler dryer sensitive garments without damage, in a household type washer and dryer or washer/dryer with a woolen cycle. In this first aspect, the method of the present invention is characterized by successively washing the garments in the washing composition of the present invention, tumbling them dry to a moisture level in the range of 10% to 15% in order to complete their drying by static drying until all remaining moisture in the garments is removed. In this first aspect, the washing composition of the present invention is used in a household type washing cycle for a time duration in the range of 1 to 15 minutes, preferably in the range of 3 to 12 minutes, at a temperature of up to 40° C. In this first aspect, the washing composition is drained after the washing step and the cycle is completed by a rinsing step and an extracting step at 500 rpm for a time duration in the range of 0.5 to 2 minutes, preferably 1 minute before drying.

In a second aspect, the method of the present invention is appropriate for cleaning and drying in a tumbler dryer sensitive garments without damage, in a commercial wet-cleaning washer and dryer or washer/dryer. In this second aspect, the method is characterized by successively washing the garments in the washing composition of the present invention, rinsing them in the conditioning composition of the present invention, tumbling them dry to a moisture level in the range of 8% to 10% in order to either complete their drying by static drying until all remaining moisture in the garments is removed, either ironed. In this second aspect, the washing composition of the present invention is used in a commercial wet-cleaning washer and dryer or washer/dryer cycle for a time duration in the range of 1 to 15 minutes, preferably in the range of 3 to 12 minutes, at a temperature of up to 40° C. In this second aspect, the washing composition is drained after the washing step and the cycle is completed by an extracting step at 500 rpm for a time duration in the range of 0.5 to 2 minutes, preferably 1 minute. In this second aspect, the conditioning composition of the present invention is used in a commercial wet-cleaning washer and dryer or washer/dryer cycle of a time duration in the range of 2 to 10 minutes, preferably 7 minutes, at a temperature of up to 40° C. In this second aspect, the conditioning composition is drained after the rinsing step and the cycle is completed by an extracting step at 500 rpm for a time duration in the range of 0.5 to 2 minutes, preferably 1 minute before drying.

In a third aspect, the method of the present invention is appropriate for cleaning and drying in a tumbler dryer sensitive garments without damage, in a commercial wet-cleaning washer and dryer or washer/dryer with a water circulation capability. In this third aspect, the method is characterized by successively washing the garments in the washing composition of the present invention, rinsing them in the preconditioning composition of the present invention, rinsing them in the conditioning composition of the present invention in order to tumble them dry completely or to a desired moisture level. In this third aspect, the washing composition of the present invention is used in a commercial wet-cleaning washer and dryer or washer/dryer cycle, as previously, for a time duration in the range of 1 to 15 minutes, preferably in the range of 3 to 12 minutes, at a temperature of up to 40° C. In this third aspect, the washing composition is drained after the washing step and the cycle is completed by an extracting step at 500 rpm for a time duration in the range of 0.5 to 2 minutes, preferably 1 minute. In this third aspect, the preconditioning composition of the present invention is used in a commercial wet-cleaning washer and dryer or washer/dryer cycle of a time duration in the range of 2 to 4 minutes, preferably 4 minutes, at a temperature of up to 40° C. In this third embodiment, the preconditioning composition is drained after the rinsing step and the cycle is completed by an extracting step at 500 rpm for a time duration in the range of 0.5 to 2 minutes, preferably 1 minute. In this third aspect, the conditioning composition of the present invention is used in a commercial wet-cleaning washer and dryer or washer/dryer cycle of a time duration in the range of 2 to 10 minutes, preferably 7 minutes, at a temperature of up to 40° C. In this third aspect, the conditioning composition is drained after the rinsing step and the cycle is completed by an extracting step at 1000 rpm for a time duration in the range of 2.5 to 5 minutes, preferably 4 minutes before drying.

These washing, preconditioning and conditioning compositions of the present invention have been designed to optimise cleaning and drying of sensitive garments in professional or household equipment and to avoid dimensional changes, shrinkage, surface damages and color loss. It is understood that these compositions of the present invention are particularly well-suited for the methods previously described in the present invention. It is also understood that these compositions could be independently used in other cleaning and/or drying methods and process dedicated to clean and/or dry sensitive garments in professional or household equipment without dimensional changes, shrinkage, surface damages and color loss. These washing, preconditioning and conditioning compositions of the present invention could be used in association with other washing, preconditioning and conditioning compositions used in the art of fabrics cleaning with professional or household equipment or in other washing, preconditioning and conditioning methods and process of the art of fabrics cleaning with professional or household equipment.

Several examples are used below to explain and illustrate the invention, but the scope of the present invention is not to be limited to these examples.

EXAMPLES

Regular Test 1. 15 kg of different wool garments of various manufacturers were selected and introduced in a 55 lb. Commercial wet-cleaning washer (brand: IMESA).
2. In a first step, the garments were washed for 7 minutes with a solution corresponding to said washing composition at 25° C. The aqueous solution was drained and extracted for 1 minute at 500 rpm.
3. In a second step, the garments were rinsed for 4 minutes at 25° C. with a solution corresponding to said preconditioning composition. The aqueous solution was drained and extracted for 1 minute at 500 rpm.
4. In a third step, the garments were rinsed for 7 minutes at 25° C. with a solution corresponding to said conditioning composition. The aqueous solution was drained and extracted for 4 minutes at 1000 rpm.
5. In a fourth step, the garments were dried in a 75 lb. Commercial dryer (brand: IMESA) to a moisture level of 3%.

Subsequent assessment revealed that the garments had no dimensional changes, no dye/color losses and were exceptionally clean with very few wrinkles similar to a dry-cleaning process.

Comparison Test 1:

Comparable (wet cleaning) products have no oil stain removal capability and do not recommend the washing and subsequent drying of the garments. The recommended drying is a 3-minute tumbling and overnight hang to dry.

Comparison test 1 was limited to the cleaning process.

Three different commercially available wet cleaning products were chosen and the same types of garments were cleaned based on the recommendations by the cleaning product manufacturers.

The cleaned garments were assessed for the cleaning effect and effect on the fibers. All three cleaning products and processes produced visible surface and color changes.

Comparison Test 2:

In comparison test 2, comparison test 1 was conducted with subsequent drying of the garments.

The cleaned and dried garments were assessed for the cleaning and drying effect and effect on the fibers.

All three cleaning products and processes produced visible dimensional changes, shrinkage and felting as well as color changes.

Household Washer Test 1:

1. Four different woollen trousers of various manufacturers were selected and introduced in a Miele W 1926 (household washer) in handwash/woollen cycle.
2. In a first step, the garments were washed with a solution corresponding to said washing composition at 25° C. The aqueous solution was drained and extracted.
3. In a second step, the garments were rinsed with water only. The aqueous solution was drained and extracted.
4. In a third step, the garments were rinsed at 25° C. with a solution corresponding to said conditioning composition. The aqueous solution was drained and extracted.
5. In a fourth step, the garments were dried in a Miele dryer T 1526 at low temperature on hand iron setting.

Subsequent assessment revealed that the trousers had no dimensional changes, no dye/color losses, very clean with few wrinkles similar to a dry-cleaning process.

Household Washer Test 2:

1. Four different woollen sweaters of various manufacturers were selected and introduced in a Miele W 1926 (household washer) in and wash/woollen cycle.
2. In a first step, the garments were washed with a solution corresponding to said washing composition at 25° C. The aqueous solution was drained and extracted.
3. In a second step, the garments were rinsed with water only. The aqueous solution was drained and extracted.
4. In a third step, the garments were rinsed at 25° C. with a solution corresponding to said conditioning composition. The aqueous solution was drained and extracted.
5. In a fourth step, the garments were dried in a Miele dryer T 1526 at low temperature on hand iron setting.

Subsequent assessment revealed that the sweaters had no dimensional changes, no dye/color losses, very clean and with very few wrinkles similar to a dry-cleaning process.

Comparison Test with Household Washer:

A comparison test was conducted with the same Miele washer and dryer, and three commercially available cleaning products for wool and sensitive fibers.

The cleaned and dried garments were assessed for the cleaning and drying effect and effect on the fibers. All cleaning three products and processes produced visible dimensional changes, shrinkage and felting as well as color changes.

The invention claimed is:

1. A method useful for cleaning in a professional or household washing machine equipment and drying in a tumbler dryer, garments and other fibers including water sensitive protein fibers without dimensional changes, surface damages, color loss, comprising the steps of:

a) washing garments with at least one washing composition consisting essentially of:
   1) water;
   2) an alcohol present at a volume ranging from 5% to 40% of the total volume of the composition wherein said alcohol is selected from the alcohols of the formula Cn H2n+1 OH where n is 1, 2, 3 or 4;
   3) anionic surface active components mixture present at a volume ranging from 4% to 60% of the total volume of the composition wherein said anionic surface active components are isopropylamine salts of a mixture of linear alkylbenzene sulfonic acids wherein the alkyl groups contain from 7 to 14 carbon atoms and about 19 to 25% of the linear alkylbenzene sulfonic acid salt have the benzene sulfonic acid in position 2 of the alkyl group;
   4) non anionic surface active components mixture present at a volume ranging from 4% to 40% of the total volume of the composition wherein said non anionic surface active components are selected from a group consisting of non-ionic primary alcohol alkoxylate wherein high linear primary alcohol represents 75-85% and contain even and odd numbered carbon chain in sub 20 wherein said non ionic primary alcohol alkoxylate is an ethoxylate alcohol with carbon atoms chain between 8 to 18 carbon atoms;
   5) a phosphate ester present at a volume ranging from 4% to 30% of the total volume of the composition wherein said phosphate ester is selected from a group consisting of complex mono- or diester with an alkyl ether carbon chain C12-C15 and EO-2-10;
   6) citric acid and soluble salts thereof, present at a volume ranging from 0.1 to 4% wherein the citric acid salts are sodium, potassium, or ammonium salts of citrate acid or a mixture thereof;
   7) phosphoric acid and soluble salts thereof present at a volume ranging from 0.1% to 5% of the total volume of the composition wherein the phosphoric acid salts are sodium, potassium or ammonium salts of phosphoric acid or a mixture thereof;
   8) acetic acid and soluble salts thereof, present at a volume ranging from 0.1 to 4% wherein the acetic acid salts are sodium, potassium or ammonium salts of acetate acid or a mixture thereof; and
   9) an organic amine present at a volume ranging from 0.1% to 4% of the total volume of the composition wherein said organic amine is selected from a group consisting of diethanolamine, triethanolamine or a mixture thereof.

2. The method according to claim 1, wherein the sensitive garments, in a household washer and dryer or washer/dryer with a woolen cycle, are successively washed using the washing composition, tumbled dry to a moisture level in the range of 10% to 15% and completed to dry by static drying until all remaining moisture in the garments is removed.

3. The method according to claim 2, wherein the washing composition is used in a household washing cycle for a time duration in the range of 1 to 15 minutes, at a temperature of up to 40° C.

4. The method according to claim 3, wherein the washing composition is drained after the washing step and the cycle is completed by a rinsing step and an extracting step at 500 rpm for a time duration in the range of 0.5 to 2 minutes, before drying.

5. The method according to claim 1, wherein the sensitive garments, in a commercial wet-cleaning washer and dryer or washer/dryer, are successively washed using the washing composition, rinsed in the conditioning composition, tumbled dry to a moisture level in the range of 8% to 10% and completed to dry by static drying until all remaining moisture in the garments is removed or ironed.

6. The method according to claim 5, wherein the washing composition is used in a commercial wet-cleaning washer and dryer or washer/dryer cycle for a time duration in the range of 1 to 15 minutes, at a temperature of up to 40° C.

7. The method according to claim 6, wherein the washing composition is drained after the washing step and the cycle is completed by an extracting step at 500 rpm for a time duration in the range of 0.5 to 2 minutes.

8. The method according to claim 5, wherein the conditioning composition is used in a commercial wet-cleaning washer and dryer or washer/dryer cycle of a time duration in the range of 2 to 10 minutes, at a temperature of up to 40° C.

9. The method according to claim 8, wherein the conditioning composition is drained after the rinsing step and the cycle is completed by an extracting step at 500 rpm for a time duration in the range of 0.5 to 2 minutes, before drying.

10. The method according to claim 1, wherein the sensitive garments, in a commercial wet-cleaning washer and dryer or washer/dryer with a water circulation capability, are successively washed using the washing composition, rinsed in the preconditioning composition, rinsed in the conditioning composition, tumbled dry completely or to a desired moisture level.

11. The method according to claim 10, wherein the washing composition is used in a commercial wet-cleaning washer and dryer or washer/dryer cycle for a time duration in the range of 1 to 15 minutes, at a temperature of up to 40° C.

12. The method according to claim 11, wherein the washing composition is drained after the washing step and the cycle is completed by an extracting step at 500 rpm for a time duration in the range of 0.5 to 2 minutes.

13. The method according to claim 10 wherein the preconditioning composition is used in a commercial wet-cleaning washer and dryer or washer/dryer cycle of a time duration in the range of 2 to 4 minutes at a temperature of up to 40° C.

14. The method according to claim 13, wherein the preconditioning composition is drained after the rinsing step and the cycle is completed by an extracting step at 500 rpm for a time duration in the range of 0.5 to 2 minutes.

15. The method according to claim 10, wherein the conditioning composition is used in a commercial wet-cleaning washer or washer/dryer cycle of a time duration in the range of 2 to 10 minutes, at a temperature of up to 40° C.

16. The method according to claim 15, wherein the conditioning composition is drained after the rinsing step and the cycle is completed by an extracting step at 1000rpm for a time duration in the range of 2.5 to 5 minutes, before drying.

17. A washing composition useful for cleaning in a professional or household washing machine equipment and drying in a tumbler dryer, garments and other fibers including water sensitive protein fibers without dimensional changes, surface damages and color loss, consisting essentially of:

(a) water;

(b) an alcohol present at a volume ranging from 5% to 40% of the total volume of the composition wherein said alcohol is selected from the alcohols of the formula Cn H2n+1 OH where n is 1, 2, 3 or 4;

(c) anionic surface active components mixture present at a volume ranging from 4% to 60% of the total volume of the composition wherein said anionic surface active components are isopropylamine salts of a mixture of linear alkylbenzene sulfonic acids wherein the alkyl groups contain from 7 to 14 carbon atoms and about 19 to 25% of the linear alkylbenzene sulfonic acid salt have the benzene sulfonic acid in position 2 of the alkyl group;

(d) non anionic surface active components mixture present at a volume ranging from 4% to 40% of the total volume of the composition wherein said non anionic surface active components are selected from a group consisting of non-ionic primary alcohol alkoxylate wherein high linear primary alcohol represents 75-85% and contain even and odd numbered carbon chain in sub 20 wherein said non ionic primary alcohol alkoxylate is an ethoxylate alcohol with carbon atoms chain between 8 to 18 carbon atoms;

(e) a phosphate ester present at a volume ranging from 4% to 30% of the total volume of the composition wherein said phosphate ester is selected from a group consisting of complex mono- or diester with an alkyl ether carbon chain C12-C15 and EO-2-10;

(f) citric acid and soluble salts thereof, present at a volume ranging from 0.1 to 4% wherein the citric acid salts are sodium, potassium, or ammonium salts of citrate acid or a mixture thereof;

(g) phosphoric acid and soluble salts thereof present at a volume ranging from 0.1% to 5% of the total volume of the composition wherein the phosphoric acid salts are sodium, potassium or ammonium salts of phosphoric acid or a mixture thereof;

h) acetic acid and soluble salts thereof, present at a volume ranging from 0.1 to 4% wherein the acetic acid salts are sodium, potassium or ammonium salts of acetate acid or a mixture thereof; and (i) an organic amine present at a volume ranging from 0.1% to 4% of the total volume of the composition wherein said organic amine is selected from a group consisting of diethanolamine, triethanolamine or a mixture thereof.

18. A preconditioning composition useful for cleaning in a professional or household washing machine equipment and drying in a tumbler dryer, garments and other fibers including water sensitive protein fibers without dimensional changes, surface damages and color loss consisting essentially of:

(a) water;

(b) an alcohol present at a volume ranging from 5% to 40% of the total volume of the composition wherein said alcohol is selected from the alcohols of the formula Cn H2n+1 OH where n is 1, 2, 3 or 4;

(c)a phosphate ester present at a volume ranging from 4% to 30% of the total volume of the composition wherein said phosphate ester is selected from a group consisting of complex mono- or diester with an alkyl ether carbon chain C12-C15 and EO-2-10;

(d) citric acid and soluble salts thereof, present at a volume ranging from 0.01% to 5% of the total volume of the composition wherein the citric acid salts are sodium, potassium, or ammonium salts of citrate acid or a mixture thereof;

(e) phosphoric acid and soluble salts thereof present at a volume ranging from 1% to 20% of the total volume of the composition wherein the phosphoric acid salts are sodium, potassium or ammonium salts of phosphoric acid or a mixture thereof; and (f) acetic acid and soluble salts thereof present at a volume ranging from 0.01% to 5% of the total volume of the composition wherein the acetic acid salts are sodium, potassium or ammonium salts of acetate acid or a mixture thereof.

19. The method according to claim 1, further including the step of rinsing garments with at least one preconditioning composition which pH value is adjusted in the range of 4 to 6, consisting essentially of:

(a) water;

(b) an alcohol present at a volume ranging from 5% to 40% of the total volume of the composition wherein said alcohol is selected from the alcohols of the formula Cn H2n+1 OH where n is 1, 2, 3 or 4;

(c) a phosphate ester present at a volume ranging from 4% to 30% of the total volume of the composition wherein said phosphate ester is selected from a group comprising complex mono- or diester with an alkyl ether carbon chain C12-C15 and EO-2-10;

(d) citric acid and soluble salts thereof, present at a volume ranging from 0.01% to 5% of the total volume of the composition wherein the citric acid salts are sodium, potassium, or ammonium salts of citrate acid or a mixture thereof;

(e) phosphoric acid and soluble salts thereof present at a volume ranging from 1% to 20% of the total volume of the composition wherein the phosphoric acid salts are sodium, potassium or ammonium salts of phosphoric acid or a mixture thereof; and (f) acetic acid and soluble salts thereof present at a volume ranging from 0.01% to 5% of the total volume of the composition wherein the acetic acid salts are sodium, potassium or ammonium salts of acetate acid or a mixture thereof.

20. The method according to claim 1, and further including the step of rinsing garments with at least one conditioning composition consisting essentially of:

(a) water;

(b) tripropylene Glycol present at a volume ranging from 0.1% to 4% of the total volume of the composition; and (c) a fluoroalkyl acrylate copolymer present at a volume ranging from 2% to 15% of the total volume of the composition wherein said copolymer is a fluroroalkyl acrylate copolymer comprising a fluorinated monomer, acrylic acid containing monomer and a calcium-, magnesium-, aluminium- acrylate or styrene sulfonate.

* * * * *